US007617567B2

(12) United States Patent
Franchini

(10) Patent No.: US 7,617,567 B2
(45) Date of Patent: Nov. 17, 2009

(54) ADJUSTABLE HINGE

(75) Inventor: Gian Carlo Franchini, Correggio (IT)

(73) Assignee: Elesa S.p.A., Milan (IT)

( * ) Notice: Subject to any disclaimer, the term of this patent is extended or adjusted under 35 U.S.C. 154(b) by 220 days.

(21) Appl. No.: 11/619,627

(22) Filed: Jan. 4, 2007

(65) Prior Publication Data

US 2007/0169311 A1 Jul. 26, 2007

(30) Foreign Application Priority Data

Jan. 12, 2006 (IT) ..... MI06A0041

(51) Int. Cl.
*E05D 7/04* (2006.01)

(52) U.S. Cl. ..... 16/236; 16/382; 16/249; 16/254

(58) Field of Classification Search ..... 16/235, 16/236, 237, 387, 382, 383, 384, 242, 243, 16/245, 246, 248, 249, 254, 271, 272; 411/539
See application file for complete search history.

(56) References Cited

U.S. PATENT DOCUMENTS

| | | | | | |
|---|---|---|---|---|---|
| 2,615,194 | A * | 10/1952 | Kreiner | 16/248 |
| 3,019,472 | A * | 2/1962 | Wasmuth | 16/249 |
| 4,035,093 | A * | 7/1977 | Redshaw | 403/4 |
| 4,554,706 | A * | 11/1985 | Rock et al. | 16/237 |
| 4,718,143 | A * | 1/1988 | Lautenschlager, Jr. | 16/238 |
| 5,664,288 | A * | 9/1997 | Lautenschlager et al. | 16/249 |
| 5,733,082 | A * | 3/1998 | Schrader | 410/115 |
| 6,058,564 | A * | 5/2000 | Purcell et al. | 16/241 |
| 6,203,231 | B1 * | 3/2001 | Salice | 403/12 |
| 6,286,185 | B1 * | 9/2001 | Ramsauer | 16/236 |
| 6,966,722 | B1 * | 11/2005 | Borror et al. | 403/3 |
| 7,478,508 | B2 * | 1/2009 | Peterson | 52/573.1 |
| 2002/0073509 | A1 * | 6/2002 | Dean | 16/387 |
| 2008/0003079 | A1 * | 1/2008 | Martinson | 411/539 |

FOREIGN PATENT DOCUMENTS

| | | | |
|---|---|---|---|
| DE | 4138915 | A1 * | 6/1993 |
| EP | 0991836 | | 4/2000 |
| JP | 06307149 | A * | 11/1994 |

* cited by examiner

*Primary Examiner*—Victor Batson
*Assistant Examiner*—Jeffrey O'Brien
(74) *Attorney, Agent, or Firm*—Pearne & Gordon LLP

(57) ABSTRACT

The invention concerns a hinge of the type including of a pair of members of a hinge (1), each having a pair of screw-anchoring holes (5). The holes are obtained within housing seats (2) prearranged for the introduction of adjusters (3, 9). Each adjuster includes a body (6) and a flange (7). The edge of the flange rests on the surface of each member of the hinge (1) in various mutual positions of the adjuster in its respective seat. According to the invention, said housing seats (2) have a centered-symmetry base layout, and guiding means (6, 11, 11*a*) are provided for guiding said adjuster body (6) into its respective housing seat (2) so as to allow the free movement of the adjuster (3, 9) in a single direction, among multiple possible directions, depending on the orientation of each adjuster (2) in its respective seat.

8 Claims, 5 Drawing Sheets

ADJUSTABLE HINGE

RELATED APPLICATIONS

This application claims the benefit of Italian application, MI2006U 000041, filed on Jan. 12, 2006, the entire disclosure of which is hereby incorporated herein by reference.

FIELD OF THE INVENTION

The present invention relates generally to a hinge, and more particularly to a hinge having adjuster elements for a fastener.

BACKGROUND OF THE INVENTION

During the installation of hinges on shutters of doors and machinery, such as access doors or the like, an operator can often find he has to adjust the relative position of the fasteners, such as anchoring screws or the like, with respect to the hinge axis. Such a need may arise for example when, during mounting, it is necessary to compensate for drilling mistakes, minimal misalignments, and/or angular positions of the shutter with respect to the frame post. In any case, there may be various other cases in which precise and secure hinge adjustment becomes a necessity.

Thus, various devices have been used in order to accomplish a hinge capable of meeting the operator's requirements in terms of speediness and versatility during hinge adjustment.

In particular, hinges have been manufactured providing through-holes for anchoring fasteners, screws, or the like on the hinge members, in correspondence of housing seats of flanged adjusters, and suitably shaped to allow a predetermined freedom of movement within said seats. The adjusters in turn have a through-hole wherein the anchoring screw substantially engages without play. This device enables the operator to arrange the screws more easily, and consequently more accurately, for anchoring the hinge in its working position, and to then move the adjuster-and-screw assembly with respect to its housing seat on the hinge, in order to accurately adjust the relative position of the shutter with respect to the post.

These known hinges, however, have the drawback of tending to become dislodged under the weight of the shutter, which are often heavy metal cabinet doors, and of hence losing their accurately adjusted original position.

In order to solve this problem it has already been suggested, in particular in EP 0991836, to manufacture in the hinge elliptically-shaped housing seats, wherein equally-elliptical through-holes are provided. The longer axis of seats and holes are arranged parallel or perpendicularly to the hinge axis. With each of these seats there is associated a flanged adjuster, itself having an elliptical base, of such a size to be able to be housed within the elliptical seat, free to move along the main axis thereof. Finally, in order to ease the stable mutual engagement between the housing seat and the adjuster, poly-grooved areas are provided perpendicular to said longer axis, on the surfaces thereof in mutual contact.

This hinge has the advantage of accomplishing an effective and stable hinge anchoring, once it is adjusted in an exact position, thanks to the mutual interlocking of the poly-grooved areas. However, it has the serious disadvantage that the adjuster movement may occur in only one predefined direction, which is the one determined by the arrangement of the housing seat, parallel or perpendicular to the hinge axis, at the time of hinge manufacture. This seriously limits the freedom of movement of the adjuster with respect to the hinge and hence the opportunity for accurate adjustment. Consequently, the manufacturer is forced to manufacture various types of hinges, which the operator will use at pleasure for any intervention he is going to perform, with evident problems in terms of costs and stocking.

In order to try and better solve this problem, another hinge available on the market provides to manufacture circular-base housing seats. On the bottom surface of the circular-based housing seats a widened through-hole is drilled, shaped for example as a square with rounded corners. An equally circular-base, flanged adjuster having, however, a smaller diameter cooperates with this seat, and said adjuster is free to move in any direction and hence also to perform a rotary movement within its respective seat. On the surfaces in mutual contact, poly-grooved areas are equally formed, which, however, in this case are cross-shaped. The shaping on the one hand of the seat and of the through-hole, and on the other of the adjuster base, allows to remarkably improve adjustment freedom. As a matter of fact, the adjuster can move both in the vertical plane and in the horizontal one. However, it cannot be engaged firmly and securely, since the poly-grooved areas do not match (i.e. they do not interlock in all positions). This is true in particular if the adjusters are accidentally rotated—as may easily occur—and consequently the engagement of the poly-grooved areas occurs in a mutually oblique position.

The object of the present invention is to provide a single type of hinge which, however, can be adjusted in a direction chosen among at least two predefined directions, preferably either horizontally or vertically, according to the requirements of the moment, and which has engagement means capable of providing a secure and stable anchoring of the adjuster in the respective housing seat thereof, in various chosen positions.

Such object is obtained by means of a hinge with the features described and claimed herein, or the equivalents thereof.

BRIEF DESCRIPTION OF THE DRAWINGS

The foregoing and other features and advantages of the present invention will become apparent to those skilled in the art to which the present invention relates upon reading the following description, given purely by way of example, with reference to the accompanying drawings, in which.

DESCRIPTION OF EXAMPLE EMBODIMENTS

Figure 1:
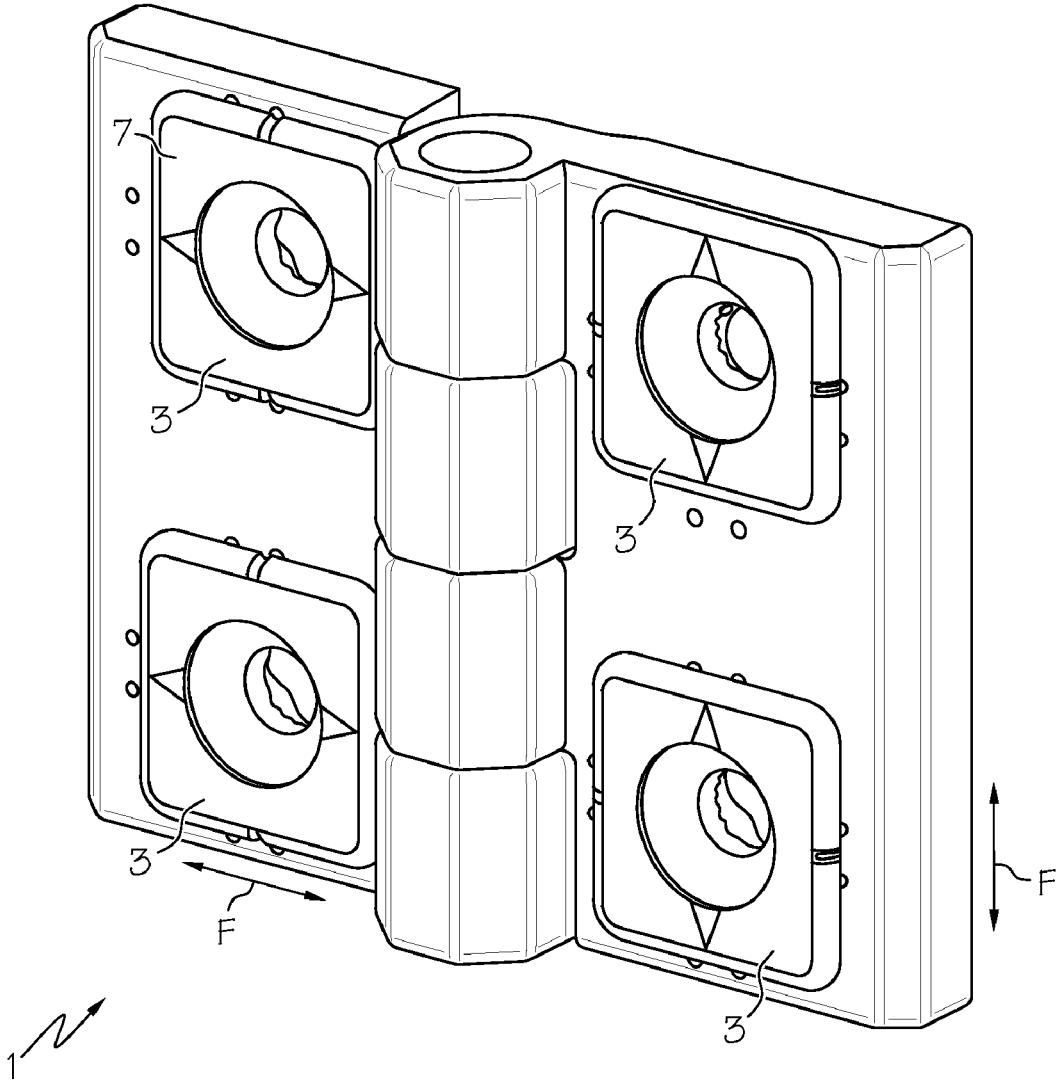
FIG. 1 shows a perspective front view of a first example embodiment of the hinge according to an aspect of the invention.
Figure 2:
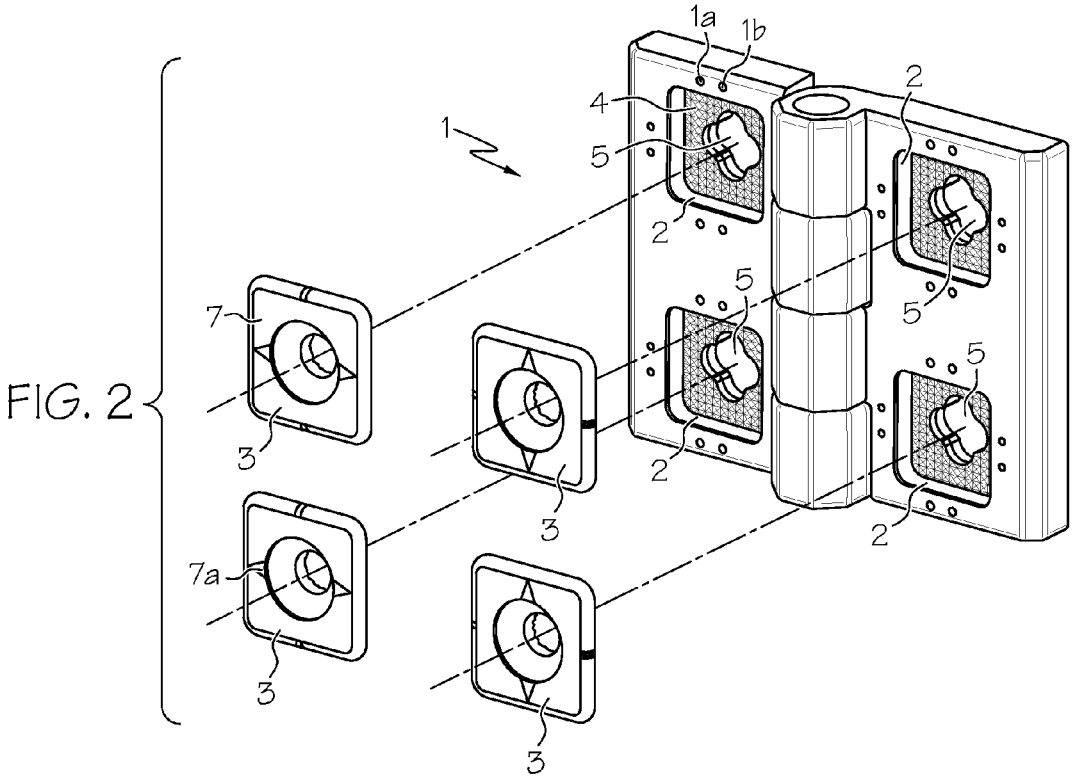
FIG. 2 is a partly-exploded view of the hinge of FIG. 1, which highlights the front structure of the flanged adjusters and of the respective housing seats, according to another aspect of the invention.
Figure 3:
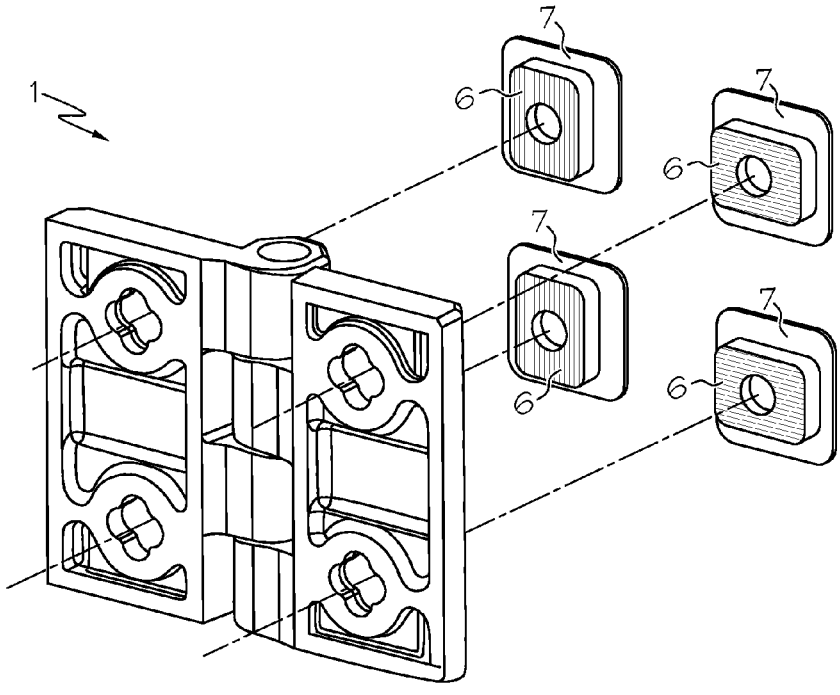
FIG. 3 is similar to FIG. 2, but shows a rear perspective view which highlights the rear structure of the flanged adjusters.

Certain terminology is used herein for convenience only and is not to be taken as a limitation on the present invention. Further, in the drawings, the same reference numerals are employed for designating the same elements.

As can be observed from FIGS. 1 to 6, a hinge body 1 can include a pair of hinge flaps connected by a hinge pin or the like on a common pivoting axis to permit rotation of the flaps relative to each other. For example, the flaps can be connected by a hinge pin or the like that can float freely between the two flaps or can even be secured to one of the flaps. As shown, one flap can rotate approximately 270° relative to the other, though various other angles are also contemplated. Additionally, the hinge body 1 and/or the adjusters can be generally molded of a thermoplastic material, such as a technopolymer, but which may be made also of other materials, such as other synthetic materials, rubber, and/or metal. An example technopolymer can include a glass-fibre reinforced polyamide based (PA) technopolymer that is resistant to solvents, oils greases, and/or other chemical agents, though others can also be used.

The hinge can include one or more, generally square-base housing seats 2, which are generally identical to one another, for the introduction of flanged adjusters 3. Though four flanged adjusters 3 are shown, it is to be appreciated that various numbers of adjusters 3 can be used. On the bottom 4 of each housing seat 2 there is provided a generally cross-shaped hole 5. For example, the holes (5) can be substantially round, cross-shaped, shaped as a quadrilobed cross, or have various other geometries.

In the example shown, the adjusters 3 are manufactured so that the body 6 thereof is generally rectangular (i.e., having one side being longer than the other) and the flange portion 7 is generally square, though either or both can have various geometries. Moreover, the body 6 is formed so that the longer side thereof is substantially the same as the sides of housing seat 4 and the shorter side is relatively smaller. As such, the adjuster 3, or the body 6 can engage with said seat 4 with minimal play in the direction of the longer side, without substantial opportunity for movement in this direction, but having maneuvering space available for the displacement thereof in the direction of the shorter side (i.e., in the direction shown by the arrows F). The edge of the flange 7, in turn generally square-shaped, as said, is capable of resting on the hinge body 1, and is sufficiently large to fully cover housing seat 2 with the various positions of the adjuster 3.

The above-described means represent means for guiding the adjusters 3 parallel to the hinge axis (i.e., in the vertical direction) or perpendicularly (i.e., in the horizontal direction) thereto, only according to the orientation with which adjusters 3 are introduced in their respective housing seat. It is to be appreciated that, where multiple adjusters are used, each adjuster can be individually and independently adjusted in either a horizontal or vertical direction.

Figure 4A:
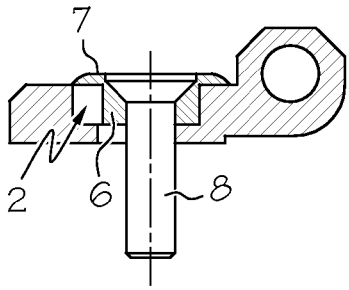
FIGS. 4A and 4B are two partial-section views of the hinge of FIG. 1, showing an adjuster and a respective anchoring fastener, in two different working positions.
Figure 4B:
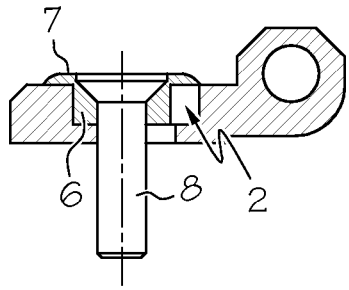

In order to better understand the arrangement during operation, FIGS. 4A and 4B illustrate two example maximum-play positions that the adjuster 3 may take up. As can be easily observed, the flange 7 takes up a position resting on the outer surface of hinge body 1, while the body 6 of adjuster 3 can move freely from one to the other of the walls within the housing seat 2, by a length generally corresponding to the difference between the side length of seat 2 and the length of the shorter side of the body 6.

The mutual engagement between the hinge body 1 and the body 6 of adjuster 3 can be further strengthened by grooves suitably formed on the surfaces of the bottom 4 of housing seat 2 and of the body 6, respectively, said surfaces being in mutual contact. More precisely, the bottom of the body 6 can have a series of grooves which run generally parallel to the longer side thereof, while on the bottom surface 4 of housing seat 2 there can be provided a plurality of substantially punctiform protrusions—each one for example being shaped as a generally square-base cusp, as is well visible in the lower portion of the enlarged view of FIG. 6—aligned both vertically and horizontally to form a sort of chequered or diamond pattern. As shown, the punctiform protrusions can be arranged in an array, such that spacing between adjacent protrusions in the array forms rows and/or columns therebetween for engagement with the grooves. In addition or alternatively, the bottom surface of the housing seat 2 and/or the body 6 can include knurling or the like.

By means of the above-described arrangement, the operator can, upon mounting the hinge, mount the adjuster 3 so that it can be displaced in a horizontal or vertical direction, respectively, at his choice. For example, the adjuster 3 can be rotated approximately 90° to select displacement in either a horizontal or vertical direction. Thus, because the grooves are generally parallel along a single direction, such as vertical, engagement of the grooves with the punctiform protrusions (e.g., engagement of the grooves within the spacing created by the rows or columns of the punctiform protrusions) permits sliding movement in the single direction (e.g., vertical), while resisting movement in a transverse direction (e.g., horizontal).

Figure 5:
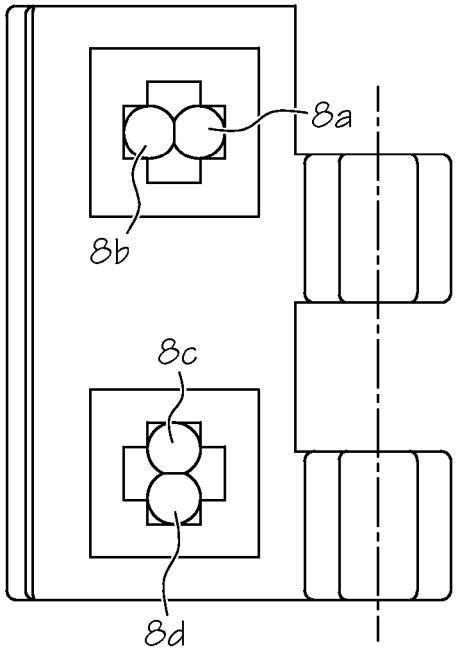
FIGS. 5 and 6 are front views of one of the two members of the hinge of FIG. 1, wherein features of the housing seat of the flanged adjuster are highlighted.
Figure 6:
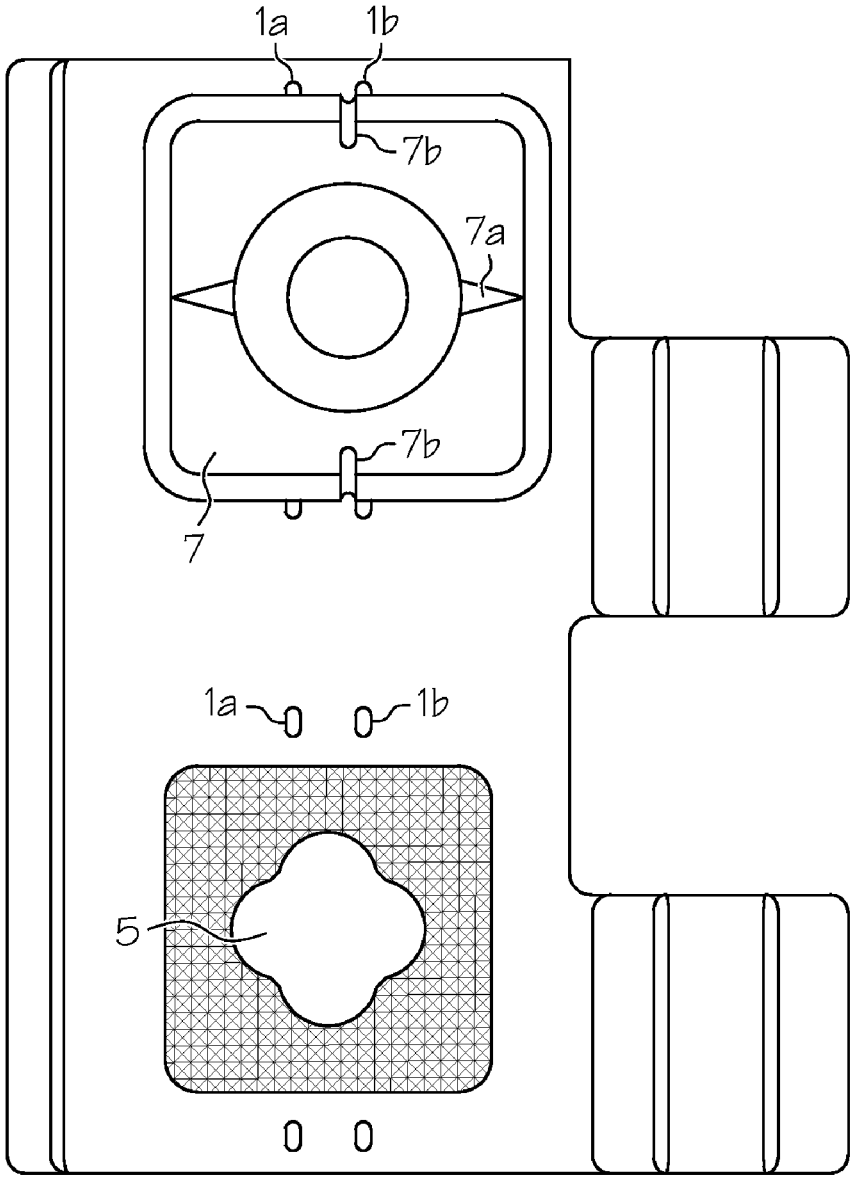

The present invention dramatically increases the opportunity for hinge adjustment and permitting the stable anchoring thereof. As shown in FIGS. 5 and 6, the cross-shaped arrangement of the hole 5 can encompass at least four different extreme positions where the anchoring screw 8, bolt, or other fastener may find itself. For example, when the body 6 of adjuster 3 is arranged as shown (FIG. 6) in the upper housing seat of the hinge, the adjuster 3 can move horizontally to bring the screw 8 as far as into extreme positions 8*a*, 8*b* rightwards and leftwards with respect to the center (as shown in the upper portion of FIG. 5). In another example, when the body 6 is arranged rotated by 90°, the adjuster 3 can move vertically to bring the screw 8 as far as into extreme positions 8*c*, 8*d* upwards and downwards with respect to the center (as shown in the lower portion of FIG. 5). It is to be appreciated that the adjusters 3 include anchoring holes that can be generally circular holes, and can include countersunk structure for use with countersunk head screws or like fasteners.

In the various positions, the body 6 of adjuster 3 is housed in the seat 2, and is also adjusted and anchored in this seat by the mutual interlocking of the grooves of the bottom surface of the body 6 in either of the horizontal or vertical alignments, respectively, of the diamond pattern located in the bottom 4 of the seat 2. This facilitates a stable and secure hinge anchoring in its working position.

In order for the operator to move the adjuster 3 in the correct direction, and avoiding wasting time to understand which one it is, there can be marks on the outer surface of the flange 7, such as arrows, notches, dots, indicia, or the like, marked by 7*a* in FIG. 6. In addition or alternatively, other arrows, notches, dots, indicia, or the like 7*b* can further be provided on the flange 7, located generally 90° to the arrows 7*a*. These notches 7*b*, by moving with respect to other fixed notches 1*a*, 1*b* on the hinge member 1, during the adjustment movement of the adjuster 3, to signal the run limits thereof in an immediately comprehensible manner.

Figure 8:
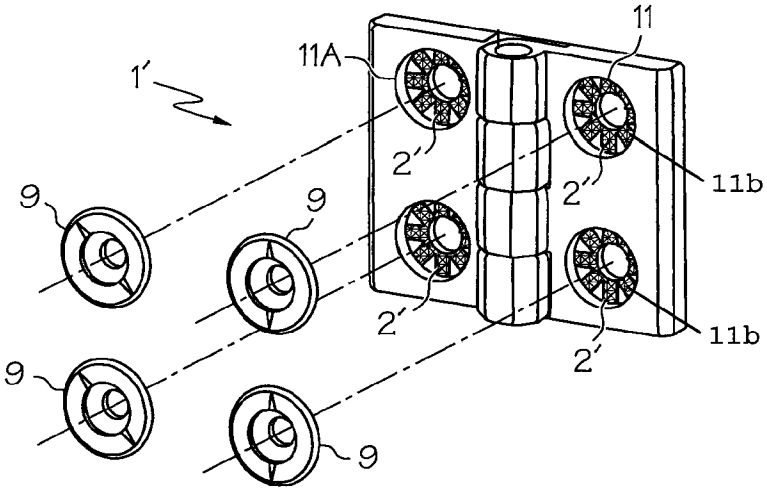
FIG. 8 is a partly-exploded view of the alternative example embodiment of FIG. 7, which highlights the front structure of the flanged adjusters.
Figure 7:
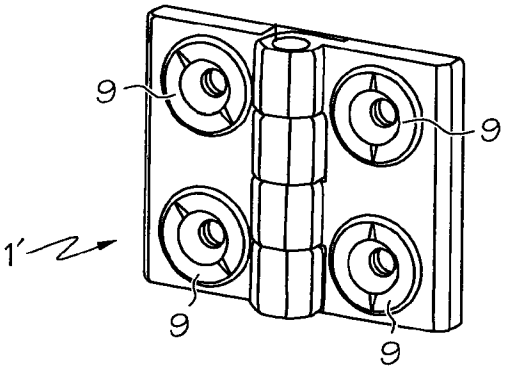
FIG. 7 is a perspective view similar to that of FIG. 1, but shows an alternative example embodiment of the hinge according to another aspect of the invention.
Figure 9:
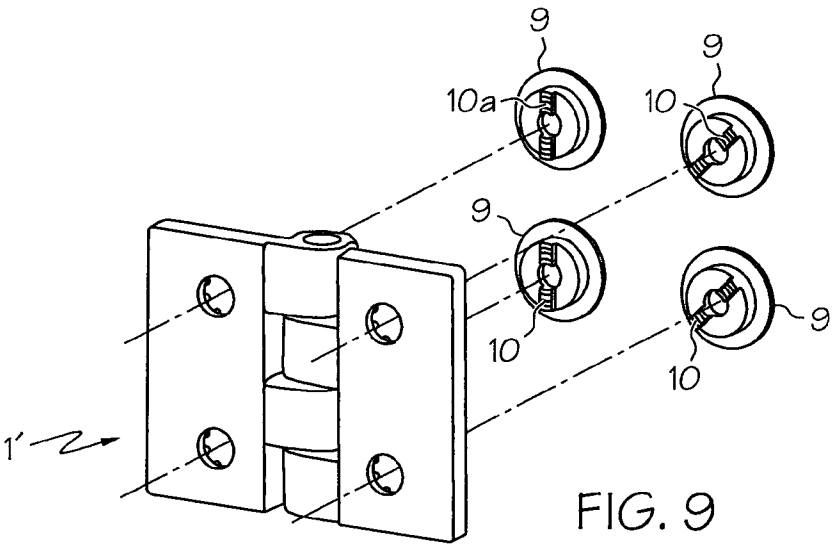
FIG. 9 is similar to FIG. 8, but shows a rear perspective view which highlights the rear structure of the flanged adjusters.

In another embodiment of the present invention, shown in FIGS. 7 to 9, the hinge 1' according to the invention can be manufactured so that the adjusters have a generally circular body, rather than a square body. Various other geometries could be used, such as triangular, hexagonal, or various other polygonal geometries. The structure of each adjuster 9 presented herein provides a diametric rib 10 forming a saddle that protruding with respect to the bottom surface of adjuster 9. Accordingly, in the housing seat 2' of the hinge, pairs of mutually-perpendicular guides 11 are obtained, which are precisely arranged parallel and perpendicularly to the hinge axis. Such guides 11 are arranged so that either one can house said saddle 10, and can engage therewith, allowing the adjuster 9 to freely slide exclusively in a single direction, selected by the operator upon positioning of the adjuster 9, according to his requirements.

In order to allow an accurate adjustment necessary to obtain the set objects, suitable interlocking means can also be prearranged in this embodiment, such as grooves or poly-grooved areas, along the surfaces 10*a* and 11*a* of the saddle 10 and of the guide 11, and oriented perpendicularly to the longitudinal direction of these surfaces, which ease accurate and secure hinge anchoring.

Operation is similar for both embodiments, and will now be described. Once the sliding direction for adjustment has been identified, the flanged adjuster 3, 9, is provided with screw 8 and is placed into a suitable seat 2. Next, the adjuster-and-screw assembly is made to adjustably slide into the seat, according to the chosen direction, until it finds the suitable position for an appropriate adjustment of the hinge and hence of the shutter, access door, etc.

Even in the case of the second example embodiment, stable anchoring is ensured by the twofold engagement, on the one hand between the adjuster 9 and the seat 2 (e.g., between saddle 10 and guide 11), which encompasses mutual sliding according to the chosen direction, and on the other hand between the opposite poly-grooved areas along the bottom surfaces thereof, which accomplishes the anchoring.

From the preceding description, it is easy to understand that, by means of the present invention, the operator is provided with a single type of hinge with adjusters that may be simultaneously adjusted, at choice, in a parallel or perpendicular manner with respect to the hinge axis, according to the requirements of the moment. The adjustment allows a secure and stable anchoring of the adjuster in the housing seat, in various chosen positions.

It is understood, however, that the invention is not to be considered limited to the specific arrangements illustrated above, which represent only example embodiments thereof, but that other variants are possible. For example, in the case of the example embodiment shown in FIGS. 7 to 9, four or more guides 11 can be formed in the housing seat 2 and arranged mutually offset by approximately 45° (11*b*), rather than only two guides offset by 90° as set forth above. It is to be appreciated that various other angles can also be utilized. Thus, the adjuster can be adjusted vertically, horizontally, or along a discrete angle relative to the vertical or horizontal axes. These variants are within the reach of a person skilled in the field, without departing from the scope of protection of the invention, as defined in the following claims or equivalents thereof.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. A hinge, of the type including a pair of hinge members (1) each including at least one hole (5) for anchoring screws, said holes being obtained within housing seats (2) arranged to allow the adjusted introduction of adjusters (3, 9), each adjuster including a body (6) and a flange (7), the edge of such flange resting on the surface of each hinge member (1) in any mutual position of the adjuster in the respective housing seat, wherein said housing seats (2) have a centered-symmetry base structure, and wherein, with a bottom surface (4) of the seat (2) and a bottom surface of the body (6) of the adjuster (3, 9), which are in mutual contact, there are associated guiding means to guide said adjuster body (6) into the respective housing seat (2), said guiding means associated with the bottom surfaces of the seat (2) and of the body (6) of the adjuster (9), said guiding means further includes a diametric rib (10) forming a saddle protruding with respect to one of said base surfaces, and of at least two guides (11) obtained in the other one of said base surfaces, said rib (10) being capable of engaging with either one of said guides (11), according to the choice of the operator mounting the hinge, so as to allow the free movement of said adjuster (3, 9) exclusively in a single direction at choice, among multiple possible directions, depending on the orientation of diametric rib (10) relative to said guides (11) within its respective seat (2), while inhibiting movement in said other multiple possible directions, wherein free movement of said adjuster (3, 9) in another of the multiple possible directions can be accomplished by removing said adjuster (3, 9) from said seat (2), rotating said adjuster (3, 9) relative to said seat (2) at an angle corresponding to another of said guides (11), and re-engaging said adjuster (3, 9) with said seat (2).

2. The hinge as claimed in claim 1, wherein a plurality of said guides (11) are arranged within said housing seats (2) in opposed pairs, each pair including one guide (11) located on opposite sides a respective one of the holes (5).

3. The hinge as claimed in claim 2, wherein four pairs of said guides (11) are arranged mutually offset by approximately 45 degrees.

4. The hinge as claimed in claim 1, wherein each of said housing seats (2) and each body (6) of the adjuster (9) has a generally round base and wherein said saddle rib (10) projects from the base surface of the body (6) and said guiding grooves (11) are formed in the bottom surface of the housing seat (2), the body (6) having a diameter relatively smaller than that of the seat (2) by a measure corresponding to the desired width of the adjustment movement of the adjuster (3) with respect to the hinge member.

5. The hinge as claimed in claim 1, wherein two of said guides (11) are provided, one being oriented parallel and the other one perpendicularly to the hinge axis.

6. The hinge as claimed in claim 5, wherein two further guides (11 *b*) are provided, oriented at 45° to the hinge axis.

7. The hinge as claimed in claim 1, wherein the bottom surface (4) of the housing seat (2) and the bottom surface of the body (6), respectively, are provided with means for mutually interlocking, said surfaces being in mutual contact, and wherein said means for mutual interlocking are formed in the bottom surfaces of the guides (11) and in the top surface of said saddle rib (10).

8. The hinge as claimed in claim 7, wherein said means for mutual interlocking includes grooves oriented perpendicularly to a length of the guides and of the saddle.

* * * * *